US006449929B1

(12) United States Patent
Guardiola

(10) Patent No.: US 6,449,929 B1
(45) Date of Patent: Sep. 17, 2002

(54) MACHINE FOR MANUFACTURING, FILLING, AND CLOSING BAGS OF MESHED FABRIC

(75) Inventor: Agustín Dauder Guardiola, Badalona (ES)

(73) Assignee: Talleres Daumar, S.A. (ES)

( * ) Notice: Subject to any disclaimer, the term of this patent is extended or adjusted under 35 U.S.C. 154(b) by 0 days.

(21) Appl. No.: 09/512,401

(22) Filed: Feb. 24, 2000

(30) Foreign Application Priority Data

Feb. 26, 1999 (ES) ..... 9900486

(51) Int. Cl.[7] ..... B65B 9/10
(52) U.S. Cl. ..... 53/567; 53/136.5; 53/290
(58) Field of Search ..... 53/567, 134.1, 53/136.5, 547, 551, 583, 267, 290, 306, 321, 370.2, 375.8, 389.3

(56) References Cited

U.S. PATENT DOCUMENTS 4,473,990 A * 10/1984 Thimon ..... 53/567

* cited by examiner

*Primary Examiner*—John Paradiso
(74) *Attorney, Agent, or Firm*—Lackenbach Siegel LLP

(57) ABSTRACT

A machine for manufacturing, filling, and closing bags of meshed fabric, from a continuous roll of meshed fabric of the type which manufactures inverted bags comprised of a portion of tubular meshed fabric closed at the top by a sheet folded over itself, which includes a first station for feeding the meshed fabric provided with first pressing members, second pressing members and cutting means; a second feeding station of the thermoweld sheet, which is to comprise the closure of the mouth of the bag, provided with a feeder device of the sheet; means of folding the sheet, means of welding the sheet; means for applying said sheet, and means of cutting the sheet; a third station for filling the bag in inverted position, provided with adjustable cams for separating the second pressing members, lower means of support for the bag, and means of filling the bag; and a fourth station for tying a belt string, closing the bottom of the bag, and unloading the filled and sealed bag, provided with a device for tying a belt string around the bag and stretching out the bag, a device for sealing the bottom of the bag, a device for opening the second pressing members and means of unloading the filled and sealed bag.

7 Claims, 10 Drawing Sheets

MACHINE FOR MANUFACTURING, FILLING, AND CLOSING BAGS OF MESHED FABRIC

SCOPE OF THE INVENTION

The present invention patent has as its object a machine for manufacturing, filling, and closing bags of meshed fabric, from a continuous roll of meshed fabric of the type of those which manufacture inverted bags comprised of a portion of tubular meshed fabric closed at the bottom by any known means and at the top by a thermoweld sheet folded over itself such that it closes the mouth of the bag.

BACKGROUND OF THE INVENTION

Within the scope of the present state of the art it is known how to envelope objects in a meshed fabric bag, particularly fruits and vegetables, in a portion of tubular meshed fabric, closed by its two ends in such a way that the aforementioned portion forms a bag for the packing of said objects.

Thus, in registrations U 9102434, P 0359046, P 0376480, P 0437594, P 0475372, P 0485227, P 0490546, P 0544008, P 9102742, and EP 0302460, there are cited apparatus and procedures for the implementation of said type of bags of meshed fabric.

In all of said registrations, the feeding of tubular meshed fabric is carried out through stretches of tubular meshed fabric arranged compressed and folded like an accordion around a rigid feeding tube, horizontal or vertical, through the inside of which there are introduced the products which are to be packaged, which generally fall into the meshed fabric by gravity. In these cases, the length of the meshed fabric rolled around the feeding tube is relatively small making frequent replacement necessary, the replacement being an inconvenience in addition. It gives rise to a discontinuous operation with unproductive down time which must be attended by one or more operators and consequently turns out to be onerous in terms of labor.

For the identification of said bags of meshed fabric, it is already known how to place a narrow strip of strong synthetic material joined to the ends of the bag, said strip serving both to bear the identification data of the origin of the products in the bag, as well as a handle for the same.

There are likewise known bags of meshed fabric which at their mouths are provided with a thermoweld plastic sheet, folded over said mouth and which serves as a closure of the same. Such type of bags are described for example in the utility models No. U 9501842 and U 9501843. Nevertheless, this type of bag is manufactured before the filling operation, which entails the necessity of two operations: a first one in which is performed the manufacture of the bag, and a second one in which the bag is separated from the bag handle, the bag is filled, and finally sealed.

The machine for manufacturing, filling, and closing bags of meshed fabric from a continuous roll of meshed fabric, which is the object of the present invention, has the characteristics defined in the following patent claims and provides among other things the advantage of affording a greater speed and productivity in the processes of packing the products in bags of meshed fabric, reducing the costs inherent to said processes and increasing its profitability.

SUMMARY OF THE INVENTION

In its essence, the machine which is the object of the present invention is characterized in that it includes four work stations disposed circumferentially and separated angularly from each other by 90 degrees, namely:

a) The first is a meshed fabric feeding station which includes first pressing members which draw the meshed fabric upwardly from a roll of tubular meshed fabric and transport it to second pressing members which pick up the meshed fabric in the upper position as well as cutting means which cut the meshed fabric into a portion corresponding to a bag.

b) The second is a feeding station of the thermoweld sheet which is to comprise the closure of the mouth of the bag, which includes a feeder device of the thermoweld sheet arranged in a roll of great length, spread out and flat; folding means of the sheet which provide it with a lengthwise folding in the center into a V; welding means of the thermoweld sheet; means for applying said sheet, which place it in a position to receive in the inside of the V fold the mouth of the bag and close it under pressure over itself, closing said mouth in the fold; and means of cutting the sheet, which cut an end portion of the same of a length greater than the width of the tubular meshed fabric.

c) The third is a station, for filling the bag in inverted position which includes adjustable cams for separating the second pressing members, which determines the opening of the bottom of the bag; lower means of support for the bag; and means of filling the bag by its bottom; and, d) The fourth is a station for tying a belt string, closing the bottom of the bag, and unloading the filled and sealed bag, which includes a device for tying a belt string around the bag and stretching out the bag, a device for sealing the bottom of the bag, a device for opening the second pressing members and means of unloading the filled and sealed bag.

According to another characteristic of the present invention, the machine includes a supporting framework, upon which are mounted a lower horizontal rotating plate, supported by a horizontal platform which does not turn but which can assume multiple positions of height, and an upper horizontal rotating plate, both upper and lower plates being pulled in a rotary motion according to an intermittent circular motion, with detents which correspond to the aforecited work stations, said circular motion being provided by a vertical central shaft which is activated by an electric motor which turns intermittently; it is integral with the upper plate and extends through the lower plate and the platform, the latter being provided with several nuts screwed onto respective threaded spindles which are capable of turning around their own axes such that due to the simultaneous turning of the screw-pins, the platform, and with it the lower turntable, can assume different positions of height, said threaded spindles being activated by a motor whose pinion moves a toothed chain which meshes with the respective toothed wheels which are integral with each screw-pin.

According to another characteristic of the present invention, the first pressing members of the first station are comprised of a vertically displaceable carriage which includes a part opening the tubular meshed fabric and a pressing device per se, said part being formed by an oblong and flattened body of lateral sides converging downwardly, intended to be introduced into the inside of the tubular meshed fabric and supported in an essentially floating position by its edges in two pairs of freely turning rollers on axles fixed to the carriage and the pressing device per se being comprised of a tube through which passes the tubular meshed fabric, and by a transverse pin through the tube activated by a pneumatic cylinder which in the position of fixation of the meshed fabric is introduced transversely into the tube and presses the meshed fabric.

According to another characteristic of the present invention, the upper horizontal turntable includes four groups of second pressing members disposed in positions separated by 90 degree angles, each one of which is comprised of two pairs of aligned pincers activated by a pneumatic cylinder, each pincer being mounted on the respective ends of two arms of a lever articulated over a common intermediate horizontal shaft of articulation and provided at its other end with a wheel which can be activated by a corresponding cam which in its actuation in the third station causes a separation of the ends of the arms of the lever bearing the pincers.

According to another characteristic of the present invention, the application means and the welding means of the thermoweld sheet of the second station are comprised of a pair of jaws activated by respective pneumatic cylinders, each jaw supporting a pressure plate and a welding head by heating, facing each other with those of the other jaw, all of which is adapted such that the overall unit, initially disposed with the jaws opened in the second station, receives in its interior the sheet folded in a V by the folding means and with the mouth of the bag disposed inside the sheet such that upon the jaws being closed the pressure plates compress between them the thermoweld sheet in a V, which closes the mouth of the bag, and the welding heads facing each other heat the thermoweld sheet and weld both sides of the V fold together.

According to another characteristic of the present invention, the lower turntable includes four groups of third pressure members disposed in positions which are angularly separated by 90 degrees, each one of which is comprised of two arms articulated so as to revolve, near the two inside ends, over respective fixed points of said lower plate, each arm being provided with a wheel which can be activated by a corresponding cam which carries it out such that the aforecited arms are actuated as levers of the first kind, all this being adapted such that each pair of arms, which defines a group of third pressure members, are joined in the first station, taking between both arms the mouth of the bag, and are kept together until they are separated at an intermediate point between the second and the third stations, remaining separated until returning to the first station, where they are activated by a movable portion of the cam for the purpose such that they close in the beginning of a new operating cycle.

According to another characteristic of the invention, the aforecited lower means of support of the bag of the third station are comprised of an essentially horizontal table disposed below the bag when the latter in its turn is below the means of filling and provided with a vertical descent movement in each operating cycle such that at the beginning of the filling operation the table is in its highest position and descends during the filling of the bag due to the action of a pneumatic cylinder until it becomes even with a fixed horizontal support surface disposed between the third and fourth stations, said fixed horizontal surface being adapted to assist in holding up the full bag until the latter reaches the means of unloading disposed in the fourth station.

BRIEF DESCRIPTION OF THE DRAWINGS

In the attached drawings there is illustrated, by way of non-limiting example, one embodiment of the machine which is the object of the present invention.

DESCRIPTION OF AN EMBODIMENT ACCORDING TO THE INVENTION

In said drawings it may be seen that the machine for manufacturing, filling, and closing bags of meshed fabric, which is the object of the present invention, includes a framework (1) which is essentially formed of several bars (6) joined together in a general rectangular form, which define four side windows (2), (3), (4), and (5) respectively, corresponding to four work stations disposed circumferentially and separated angularly by 90 degrees.

Figure 1:
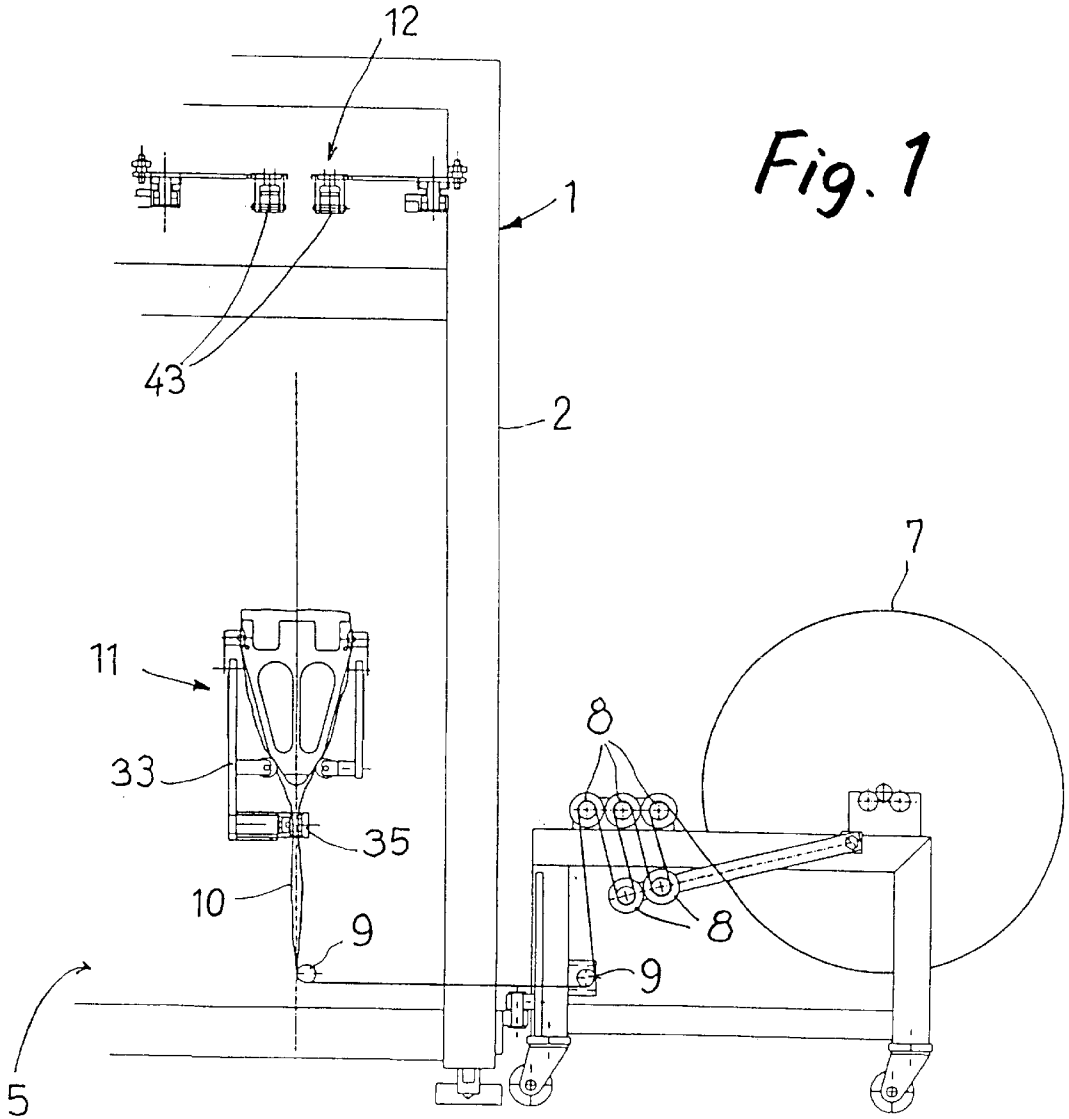
FIG. 1 is a schematic view of a front elevation of the side of the machine corresponding to the fourth station in which is seen the feeding of the tubular meshed fabric.
Figure 3:
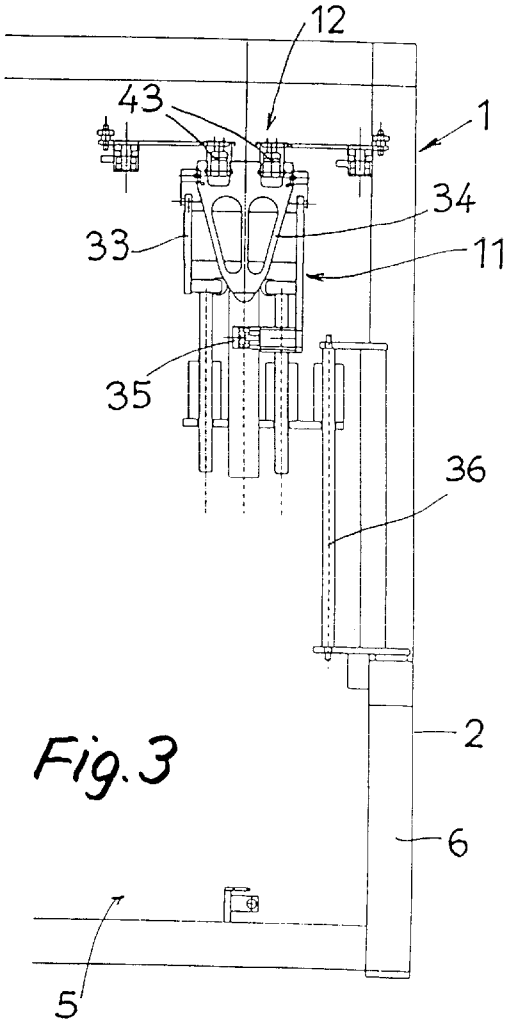
FIGS. 2 and 3 illustrate paths viewed analogously to FIG. 1 corresponding to respective positions of the first and second pressing members.
Figure 2:
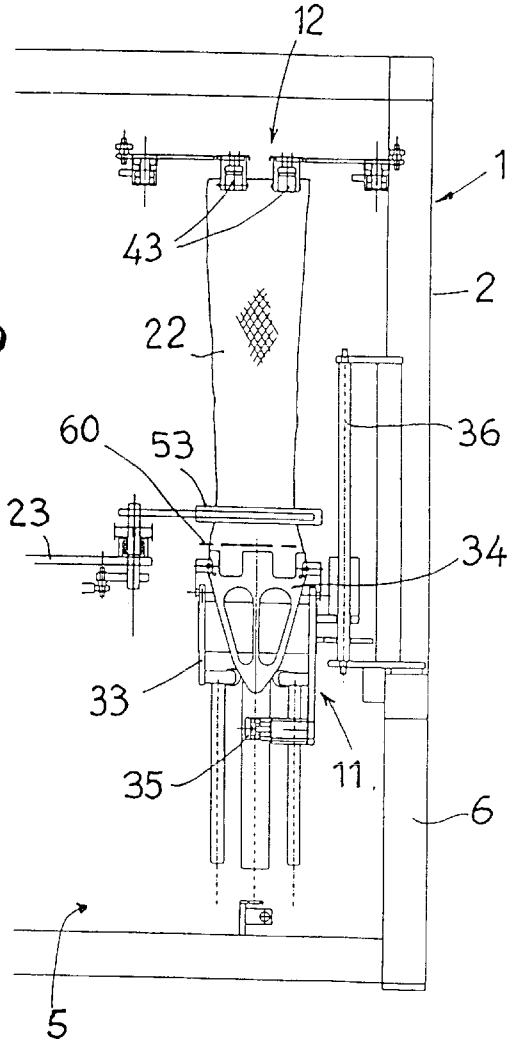
Figure 5:
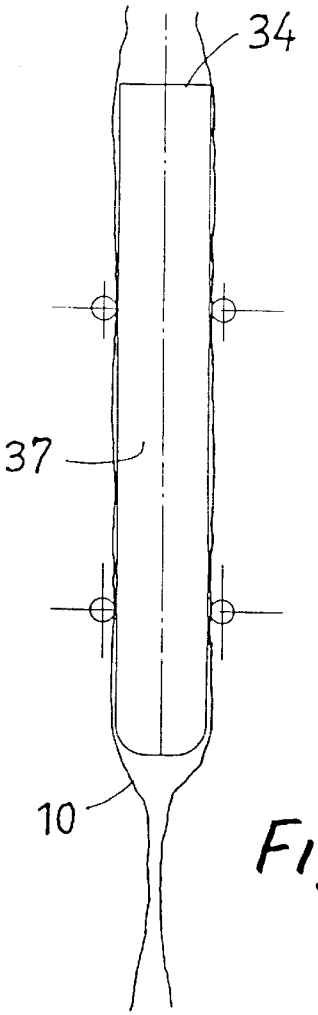
FIGS. 4 and 5 are respective schematic views in front elevation and profile in enlarged scale of the first pressing members.

The first work station which corresponds to the window (2) is a meshed fabric (10) feeding station. The meshed fabric (10) is rolled up on a large roll (7) from which it is unrolled through several rollers (8) and (9) and reaches first pressing members (11) which draw the meshed fabric (10) upwardly from the roll (7) and transport it to second pressing members (12) which hold the meshed fabric (10) in the upper position. The first station includes likewise means of cutting known in an of themselves and not represented in the drawings which cut by (60) (FIG. 2) the meshed fabric (10) into a portion corresponding to one bag.

The second station, which corresponds to the vertical side window (3), is a station for feeding the thermoweld sheet (13) which is to comprise the sealing of the mouth of the bag. Said second station includes a feeder device of the thermoweld sheet (13) arranged on a roll of great length (14) on which it is stored in an unfolded and flat form. Likewise, the second station includes means of folding the sheet which give to it a center folding lengthwise into a V determined by a lengthwise edge (16), welding means (17) of the sheet (13) and application means (18) of said sheet (13) which place it in a position to receive in the inside of the V fold the mouth of the bag at the same time it is closed under pressure onto itself, sealing said mouth in the fold.

Figures 8, 9:
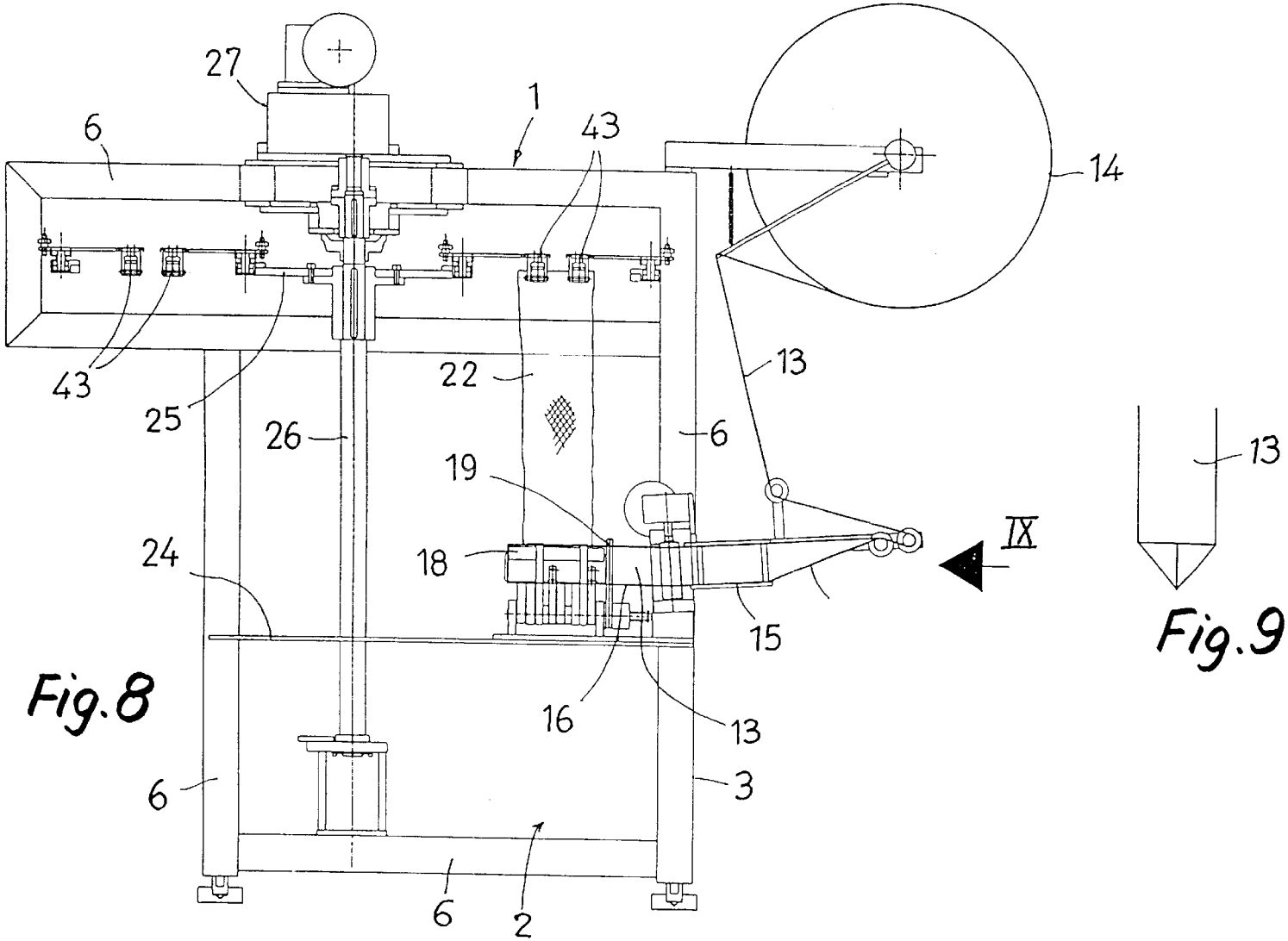
FIG. 8 is a schematic view in front elevation of the side corresponding to the first station in which is seen the feeder device of the thermoweld sheet.
FIG. 9 shows a view according to IX of FIG. 8.

The second station also includes means of cutting (19) the sheet (13) which cut an end portion of the same of a length somewhat greater than the width of the tubular meshed fabric (10) as can be seen in FIG. 8.

The third station which corresponds to the vertical side window (4) is a station for filling the bag (22) in an inverted position which includes cams (20), (21) which are adjustable for separating the second pressing members for the purpose of determining the opening of the bottom of the bag (22). Likewise the third station includes means of lower support and means for filling the bag (22) by its bottom, known per se.

Figure 7:
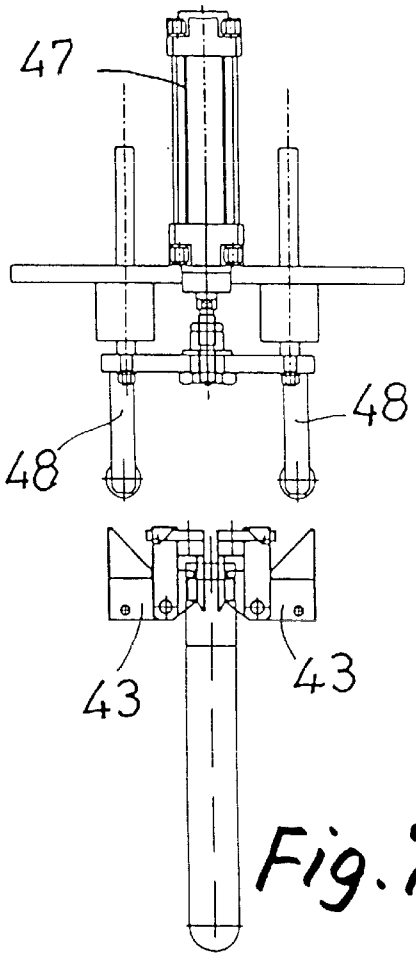
FIGS. 6 and 7 show some schematic views in front elevation and in enlarged scale of the pincers of the second pressing members.
Figure 6:
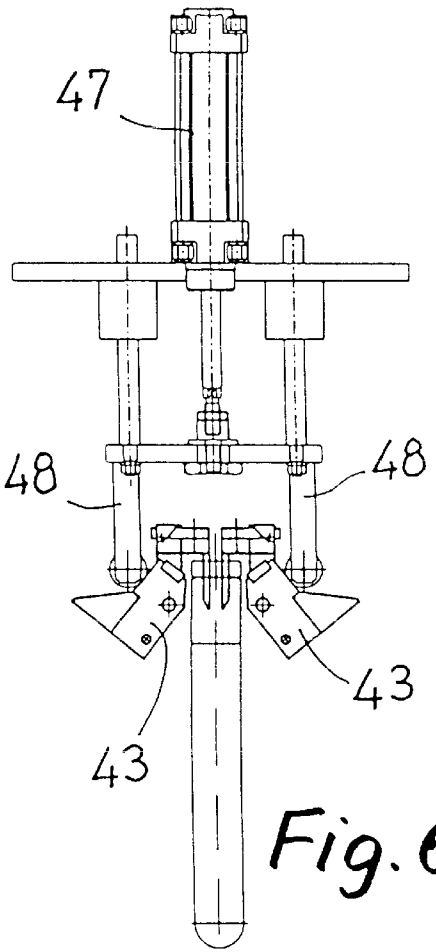

The fourth station, which corresponds to the vertical side window (5), is a station for tying a string around the bag, for closing the bottom of the bag (22) and for unloading the full and sealed bag. This station includes several devices known per se which are comprised of a string tying device and a stretcher of the bag, a device for closing the bottom of the bag (22) and means of unloading the filled and sealed bag. Likewise, the fourth station includes a device for opening the second pressing members (12) illustrated in FIGS. 6 and 7.

Over the supporting framework (1) are mounted a lower horizontal turntable (23) supported by a horizontal platform (24) devoid of turning movement but capable of rising to multiple positions of height. The framework (1) likewise includes an upper horizontal turntable (25) which, together with the lower plate (23), is drawn into turning according to an intermittent circular motion provided by a central vertical shaft (26) with detents which correspond to the aforecited work stations. The shaft (26) is activated by an electric motor (27) of intermittent rotation, is integral with the upper plate (25) and crosses the lower plate (23) and the platform (24).

Figure 11:
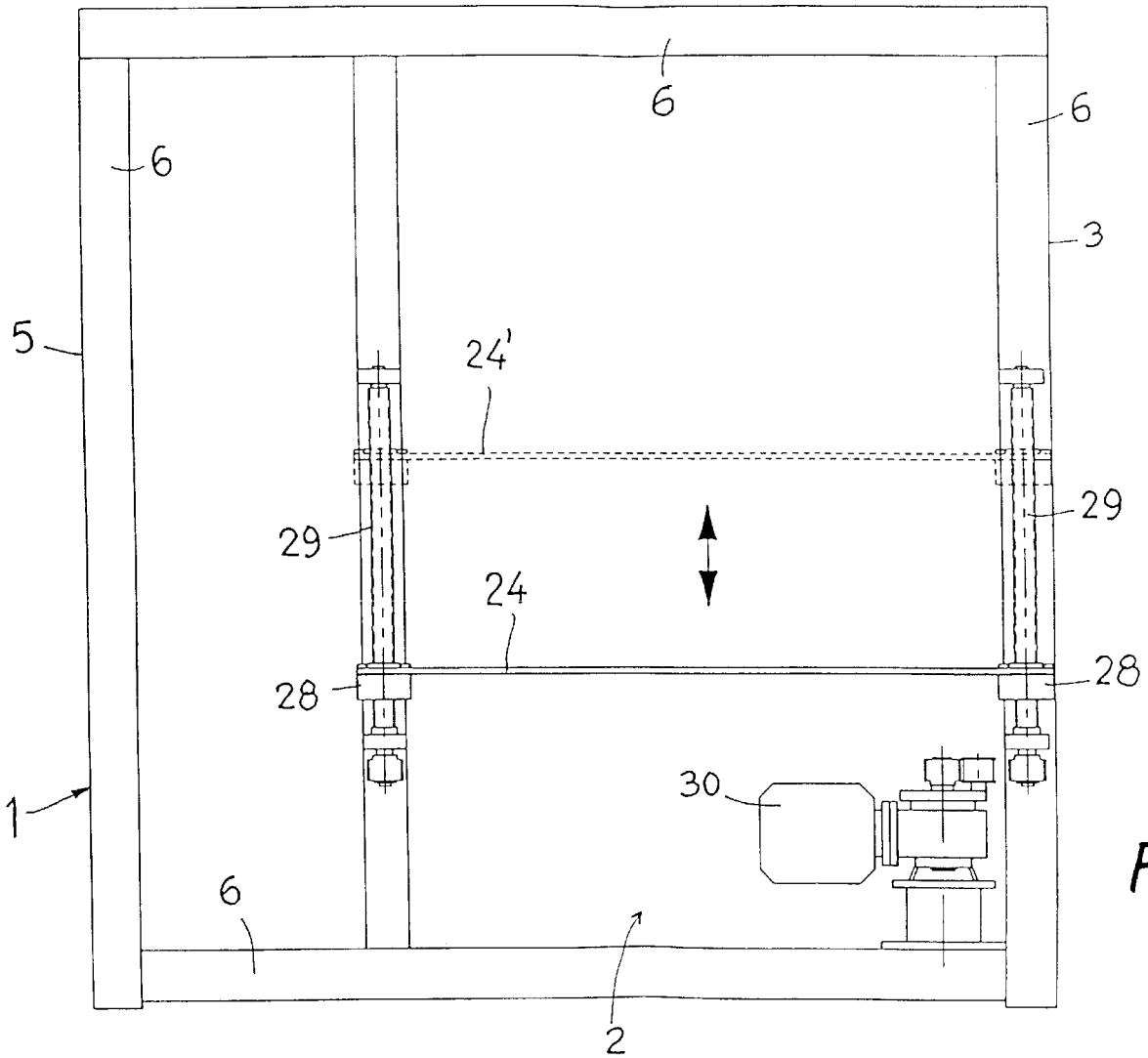
FIGS. 11 and 12 are paths seen of the machine in front elevation and in plan view respectively and the means of displacement above of the same.
Figure 12:
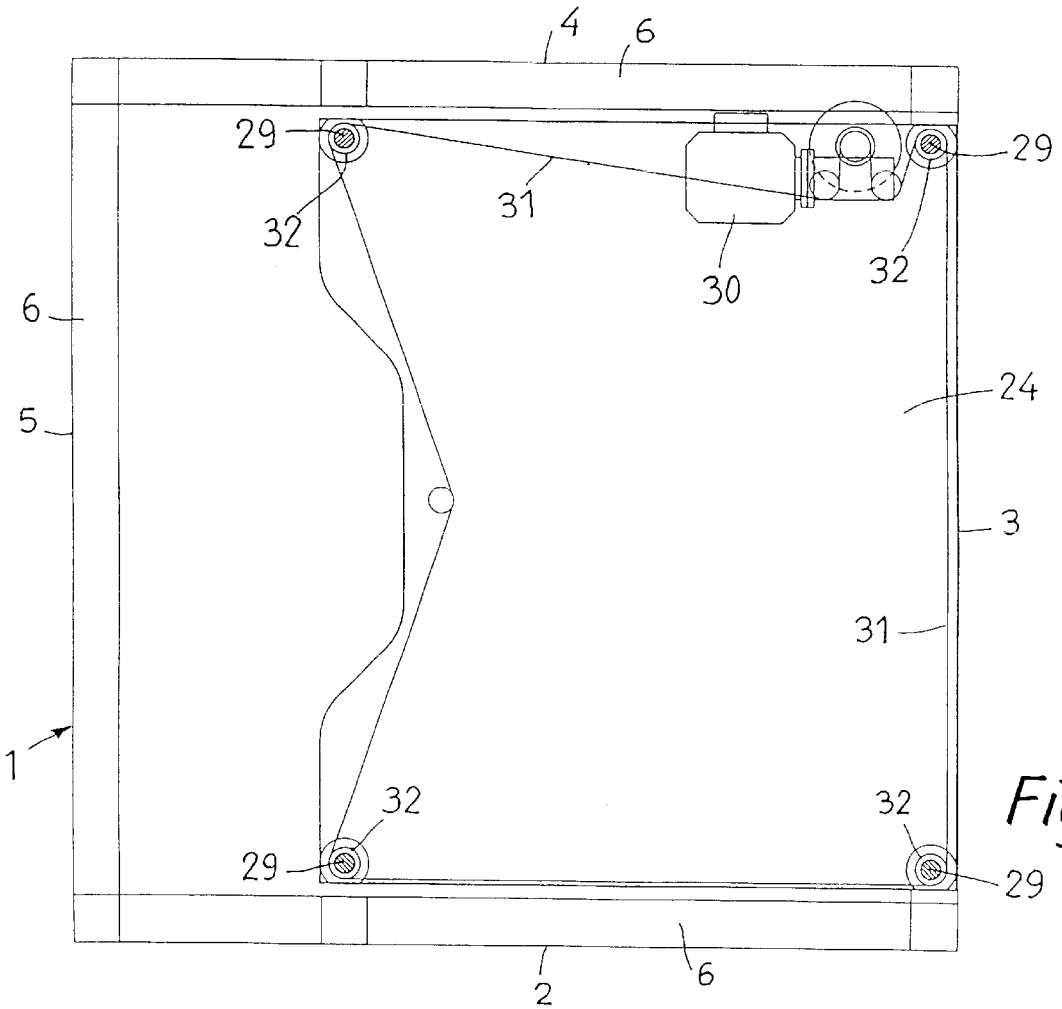
Figure 13:
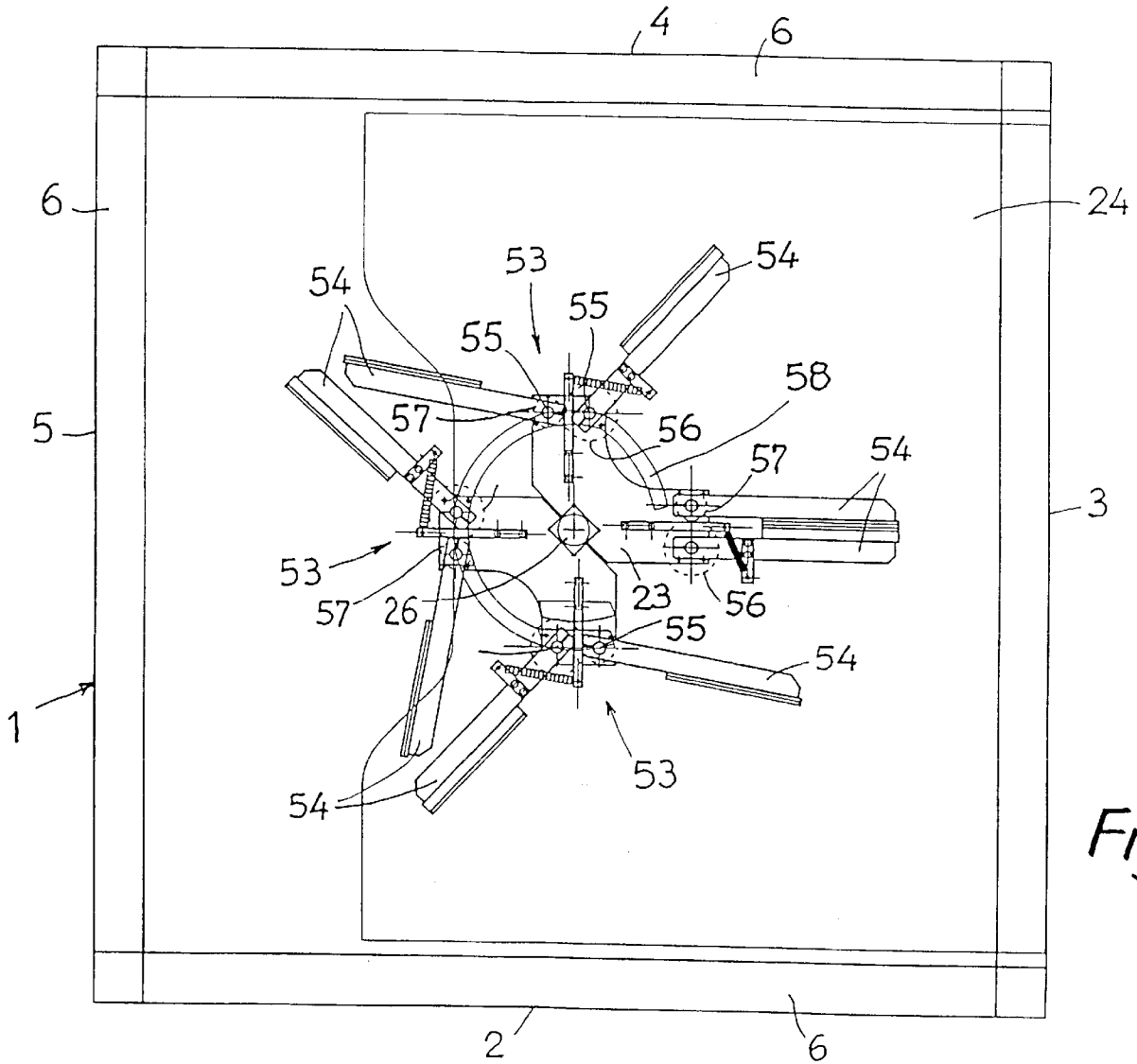
FIG. 13 is a plan view of the lower turntable.

Said platform (24) is provided with several nuts (28) screwed onto respective vertical threaded spindles (29) which are capable of turning around their own axes. The screw-pins (29) are activated by a motor (30) whose pinion moves a toothed chain (31) which meshes with the respective toothed wheels (32) which are respectively integral with each screw-pin (29). In this way, due to the simultaneous turning of the screw-pins (29), the platform (24), and with it the lower turntable (23), can adopt distinct positions in height, as can be seen in (24') in FIG. 11.

The first pressing members (11) of the first station are comprised of a vertically displaceable carriage (33) which includes a part (34) opening the tubular meshed fabric (10) and a pressing device (35) per se. The carriage (33) is activated by several telescopically arranged pneumatic cylinders and is guided over several bars (36).

Figure 4:
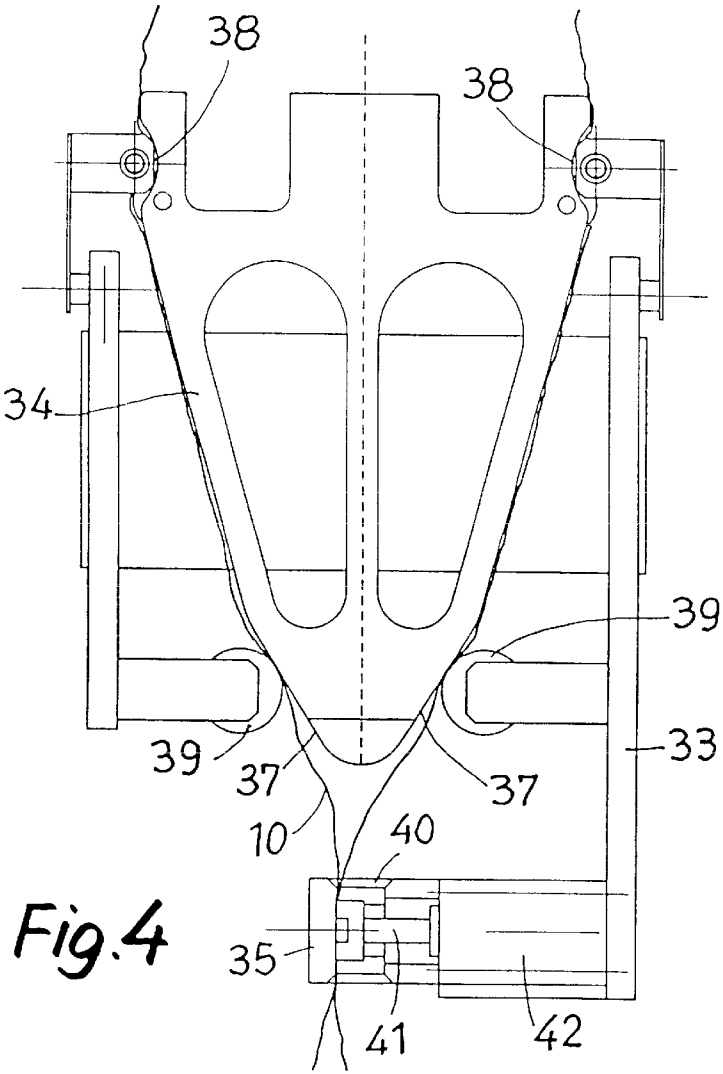

The aforecited opening part (34) is formed by an oblong and flattened body of lateral sides (37) converging downwardly, intended to be introduced into the inside of the tubular meshed fabric (10) and supported in an essentially floating position by its edges on two pairs of freely turning rollers (38), (39) on axles fixed to the carriage (33). The pressing device (35) per se is comprised of a tube (40) through which passes the tubular meshed fabric (10) there being disposed a transverse pin at the orifice of the tube (4) comprised of the piston (41) of a cylinder (42) which upon being actuated presses the tubular meshed fabric (10) against the inside wall of the tube (40) as can be seen in FIG. 4, the meshed fabric (10) thus being firmly subject to it.

The upper horizontal turntable (25) includes four groups of second pressing members (12) disposed in positions separated angularly by 90 degrees.

Each group of second pressing members (12) is comprised of two pairs of pincers (43) activated by a pneumatic cylinder (47) whose piston is bifurcated into two arms (48) which upon descending (FIG. 6) open the pincers (43) and which upon being raised (FIG. 7) cause the pincers (43) to return to the closed position due to corresponding springs, not represented, which maintain said pincers (43) in the closed position.

Figure 14:
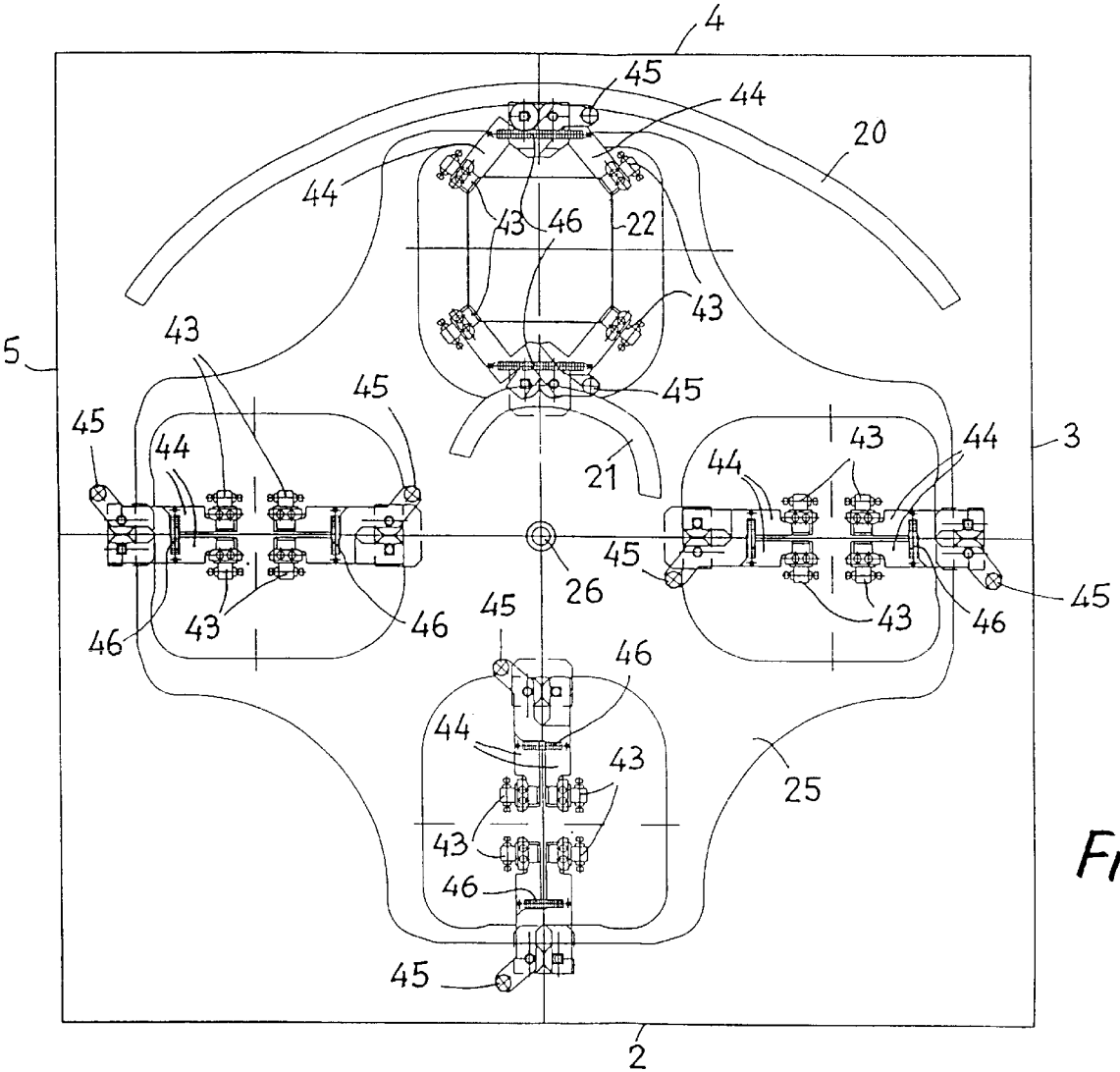
FIG. 14 illustrates a plan view of the upper turntable.

The pincers (43) of each pair are mounted on the respective ends of two arms of a lever (44) articulated and provided on its other end with a wheel (45) which can be applied to a respective cam (20), (21) which in its actuation in the third station causes a separation of the ends of the arms (44) of the lever bearing the pincers (43), with which [separation] the bottom of the bag (22) held between the pincers (43) opens as can be seen in the upper position illustrated in FIG. 14, thus creating an opening which facilitates the filling of the bag (22). Once the action of the cams (20, 21) ceases, the ends of the arms (44) go back together due to the action of recovery springs (46).

Figure 10:
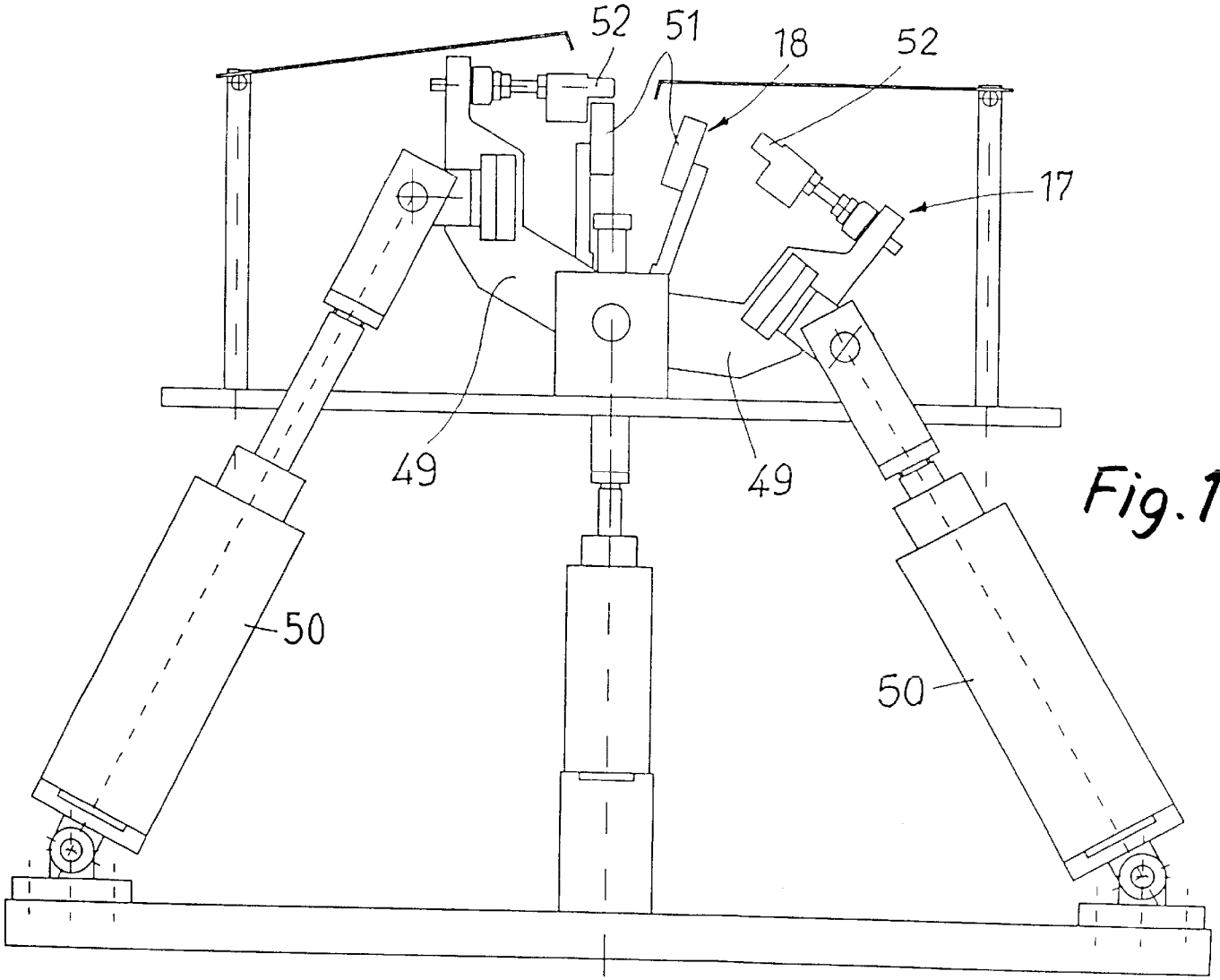
FIG. 10 illustrates a schematic view in front elevation and in enlarged scale of the means of folding and of the means of carrying the thermoweld sheet.

The application means (18) and the welding means (17) of the thermoweld sheet (13) (FIGS. 8, 9, and 10) are comprised of a pair of jaws (49) activated by respective pneumatic cylinders (50). Each jaw (49) supports a pressure plate (51) and a welding head (52) by heating, facing those of the other jaw (49). The overall unit, initially disposed with the jaws (49) opened in the second station, is adapted to receive in its interior the sheet (13) folded in a V by the folding means (15) and with the mouth of the bag disposed inside the sheet (13) such that upon the jaws (49) being closed the pressure plates (51) compress against them the thermoweld sheet (13) in a V which closes the mouth of the bag, and the welding heads (52) facing each other heat the thermoweld sheet (13) and weld both sides of the fold together.

The lower turntable (23) contains four groups of third pressure members (53) disposed in positions angularly separated by 90 degrees.

Each one of said pressing members (53) is comprised of two arms (54) articulated so as to revolve near the two inside ends over respective fixed points (55) of said lower plate (23). Each arm is provided with a wheel (56), (57) which can be activated by a corresponding cam (58) which carries it out such that the aforecited articulated arms (54) act as levers of the first kind.

Each pair of arms (54) which defines a group of third pressure members (53) are joined in the first station, taking between both arms (54) the mouth of the bag (22), and are kept together until they are separated at an intermediate point between the second and the third stations, remaining separated until returning to the first station, where they are activated by a movable portion (59) of the cam (58) for the purpose that they close in the beginning of a new operating cycle.

It should be noted that in the implementation of the object of the present invention there may be applied all of the variants of detail which experience and practice may advise, particularly as concerns complementary operating phases and other conditions of an accessory nature. There may also be introduced as many modifications of detail as may be compatible with the essence of the machine claimed, all this remaining included in the spirit of the following patent claims.

What is claimed is:

1. A machine for manufacturing, filling, and closing bags of meshed fabric from a continuous roll (7) of meshed fabric of the type which manufacture inverted bags (22) comprised of a portion of tubular meshed fabric (10) closed at the bottom by any known means and at the top by a thermoweld sheet (13) folded over itself such that it closes the mouth of the bag, characterized in that it includes four work stations disposed circumferentially and separated angularly by 90 degrees, namely:

a) the first is a meshed fabric feeding station which includes first pressing members (11) which draw the meshed fabric upwardly from a roll (7) of tubular meshed fabric and transport it to second pressing members (12) which pick up the meshed fabric in the upper position, as well as cutting means which cut the meshed fabric into a portion corresponding to a bag, b) the second is a feeding station of the thermoweld sheet which is to comprise the closure of the mouth of the bag, which includes a feeder device of the thermoweld sheet (13) arranged in a roll (14) of great length, spread out and flat; folding means (15) of the sheet which provide it with a lengthwise folding in the center into a V; welding means (17) of the thermoweld sheet; means (18) for applying said sheet which place it in a position to receive in the inside of the V fold the mouth of the bag and close it under pressure over itself, closing said mouth in the fold; and means (19) of cutting the sheet, which cut an end portion of the same of a length somewhat greater than the width of the tubular meshed fabric.

c) the third is a station for filling the bag in inverted position which includes adjustable cams (20, 21) for separating the second pressing members (12), which determines the opening of the bottom of the bag; lower means of support for the bag; and means of filling the bag by its bottom, and d) the fourth is a station for tying a belt string, closing the bottom of the bag, and unloading the filled and sealed bag, which includes a device for tying a belt string around the bag and stretching out the bag, a device for sealing the bottom of the bag, a device for opening the second pressing members and means of unloading the filled and sealed bag.

2. A machine according to claim 1, characterized in that it includes a supporting framework (1), upon which are mounted a lower horizontal rotating plate (23) supported by a horizontal platform (24) which does not turn but which can assume multiple positions of height, and an upper horizontal rotating plate (25), both upper and lower plates being pulled in a rotary motion according to an intermittent circular motion, with detents which correspond to the aforecited work stations, said circular motion being provided by a vertical central shaft (26) which is activated by an electric motor (27) which turns intermittently; it is integral with the upper plate and runs through the lower plate and the platform, the latter being provided with several nuts (28) screwed onto respective threaded spindles (29) which are capable of turning around their own axes such that due to the simultaneous turning of the screw-pins, the platform, and with it the lower turntable, can assume different positions in height, said threaded spindles being activated by a motor (30) whose pinion moves a toothed chain (31) which meshes with several respective toothed wheels (32) which are integral with each screw-pin.

3. A machine according to claim 1, characterized in that the first pressing members (11) of the first station are comprised of a vertically displaceable carriage (33) which includes a part (34) opening the tubular meshed fabric and a pressing device per se (35), said part (34) being formed by an oblong and flattened body of lateral sides (37) converging downwardly, intended to be introduced into the inside of the tubular meshed fabric (10) and supported in an essentially floating position by its edges in two pairs of freely turning rollers (38, 39) on axles fixed to the carriage and the pressing device per se being comprised of a tube (40) through which passes the tubular meshed fabric (10), and by a transverse pin (41) through the tube activated by a pneumatic cylinder (42) which in the position of fixation of the meshed fabric is introduced transversely into the tube and presses the meshed fabric.

4. A machine according to claim 1, characterized in that the upper horizontal turntable (25) includes four groups of second pressing members (12) disposed in positions separated angularly by 90 degrees, each one of which is comprised of two pairs of aligned pincers (43) activated by a pneumatic cylinder, each pincer being mounted on the respective ends of two arms of a lever (44) articulated and provided at its other end with a wheel (45) which can be activated by a corresponding cam which by its actuation in the third station causes a separation of the ends of the arms of the lever bearing the pincers.

5. A machine according to claim 1, characterized in that the application means (18) and the welding means (17) of the thermoweld sheet (13) of the second station are comprised of a pair of jaws (49) activated by respective pneumatic cylinders (50), each jaw supporting a pressure plate (51) and a welding head (52) by heating, mutually facing those of the other jaw, all of which is adapted such that the overall unit, initially disposed with the jaws opened in the second station, receives in its interior the sheet folded into a V by the folding means (15) and with the mouth of the bag disposed inside the sheet such that upon the jaws being closed the pressure plates compress between them the thermoweld sheet into a V which closes the mouth of the bag, and the welding heads, facing each other, heat the thermoweld sheet and weld both sides of the V fold together.

6. A machine according to claim 1, characterized in that the lower turntable (23) includes four groups of third pressure members disposed in positions which are angularly separated by 90 degrees, each one of which is comprised of two arms (54) articulated so as to revolve, near the two inside ends over respective fixed points (55) of said lower plate, each arm being provided with a wheel (56, 57) which can be activated by a corresponding cam (58) which carries it out such that the aforecited arms are actuated as levers of the first kind, all this being adapted such that each pair of arms which defines a group of third pressure members are joined in the first station, taking between both arms the mouth of the bag, and are kept together until they are separated at an intermediate point between the second and the third stations, remaining separated until returning to the first station, where they are activated by a movable portion (59) of the cam for the purpose such that they close in the beginning of a new operating cycle.

7. A machine according to claim 1, characterized in that the aforecited lower means of support of the bag of the third station are comprised of an essentially horizontal table disposed below the bag (22) when the latter in its turn is below the means of filling and provided with a vertical descent movement in each operating cycle such that at the beginning of the filling operation the table is in its highest position and descends during the filling of the bag due to the action of a pneumatic cylinder until it becomes even with a fixed horizontal support surface disposed between the third and fourth stations, said fixed horizontal surface being adapted to assist in holding up the full bag until the latter reaches the means of unloading disposed in the fourth station.

* * * * *